United States Patent [19]

Luckey

[11] Patent Number: 4,898,704

[45] Date of Patent: Feb. 6, 1990

[54] COAGULATING PROCESS FOR FILAMENTS

[75] Inventor: David W. Luckey, Richmond, Va.

[73] Assignee: E. I. Du Pont De Nemours & Co., Wilmington, Del.

[21] Appl. No.: 238,109

[22] Filed: Aug. 30, 1988

[51] Int. Cl.[4] ..... D01D 5/06

[52] U.S. Cl. ..... 264/180; 264/181; 264/184; 264/211.16

[58] Field of Search ..... 264/180, 181, 184, 211.14, 264/178 F, 211.16

[56] References Cited

U.S. PATENT DOCUMENTS

| | | | |
|---|---|---|---|
| 2,324,397 | 7/1943 | Hull | 264/180 |
| 3,061,402 | 10/1962 | Sanders | 264/180 |
| 3,767,756 | 10/1973 | Blades | 264/184 |
| 3,833,438 | 8/1974 | Kaneko et al. | 156/167 |
| 4,298,565 | 11/1981 | Yang | 264/181 |
| 4,340,559 | 7/1982 | Yang | 264/181 |
| 4,702,876 | 10/1987 | Ebreqt et al. | 264/184 |

FOREIGN PATENT DOCUMENTS

| | | | |
|---|---|---|---|
| 0172001 | 2/1986 | European Pat. Off. | 264/180 |

OTHER PUBLICATIONS

*Rev. Sci. Instrum.*, Vol. 53, No. 12, pp. 1855–1858, 1982, Harri et al.

*Applied Physics*, Vol. 3, pp. 387–391, 1974, Wellegehausen et al.

*Primary Examiner*—Hubert C. Lorin

[57] ABSTRACT

Coagulating a warp of filaments from a linear spinneret by delivering a transparent, jetted sheet of coagulating liquid equally and uniformly along each side of the warp.

6 Claims, 6 Drawing Sheets

COAGULATING PROCESS FOR FILAMENTS

FIELD OF THE INVENTION

This invention relates to an improved process for the spinning production of filaments. More particularly, this invention relates to such an improved process wherein filaments of aromatic polyamide can be spun at a substantially increased rate while maintaining a high tenacity.

BACKGROUND AND PRIOR ART

Blades, U.S. Pat. No. 3,767,756, describes so-called air-gap spinning of anisotropic acid solutions of aromatic polyamides through a noncoagulating fluid, for example, air, and then into a coagulating liquid, for example, water. The spinnerets disclosed in Blades have a radial configuration of apertures and the filaments are coagulated in relatively still coagulating baths.

Yang, U.S. Pat. No. 4,340,559, describes a process improved over that disclosed in Blades. In Yang, the anisotropic spinning solution is passed through a layer of noncoagulating fluid, into a shallow, flowing, bath of coagulating liquid, and out of the bath through an exit orifice at the bottom of the bath, along with overflow coagulating liquid. The flow of coagulating liquid in the bath is nonturbulent but becomes turbulent at the site of localized jets arranged symmetrically about the exit tube and below but closely adjacent to the exit orifice. Moreover, flow of the coagulating liquid is increased by the force of the jets. Jets mentioned in Yang are radial or circular and are used to direct coagulating liquid in addition to the coagulating liquid which is caused to cascade, by free-fall, down the sides of the spin tube of small, circular, cross-section.

In the Yang apparatus, individual filaments are dragged over a solid lip or edge at the orifice from the bath.

European Patent Application 85/305646, published Feb. 19, 1986 as EP 172,001, discloses a process for spinning high-strength, high-modulus aromatic polyamide filaments using a free-falling coagulating bath. The filaments are produced by air-gap spinning an anisotropic solution of the polyamide in sulfuric acid, forming a single vertical warp of filaments, and conducting the filaments vertically downward into a gravity-accelerated and free-falling coagulating liquid. The coagulating liquid may be caused to be free-falling by passing the liquid over the edge of a continuously supplied reservoir so that the liquid forms a waterfall. After the filaments have been formed by contact with the coagulating liquid, they may be contacted with additional coagulating liquid such as by a side stream of liquid fed into the gravity-accelerated and free-falling coagulating liquid. Such a side stream may be fed into the existing stream in a nonturbulent manner and at about the speed of the filaments.

A "warp" is defined herein as an array of filaments aligned side-by-side and essentially parallel.

SUMMARY OF THE INVENTION

The present invention provides a process and an apparatus for preparing filaments from a solution of polymer by extruding the solution through linearly arranged apertures in a spinneret; that is, through apertures arranged in rows and staggered to provide a vertical warp of uniformly spaced filaments which travel downward through an air gap, and are coagulated and forwarded to a collecting means. Jets are located on each side of the warp adjacent the spinneret for jetting opposed sheets of liquid from each side of the warp at an angle with the warp to meet at a common line across the width of the warp below the face of the spinneret to coagulate the filaments. Each of the sheets of liquid is wider than the warp at the common line and each has a vertically downward component of velocity less than the downward velocity of the filaments.

This invention is particularly directed toward preparing para-aromatic polyamide filaments from an optically anisotropic acid solution of the para-aromatic polyamide by extruding an acid solution of the aromatic polyamide through linearly arranged apertures and coagulating the warp, thus formed, by jetted sheets of coagulating liquid.

The sheets, after meeting, join and envelop the filaments;—moving at a velocity from about 20 to about 99% of the velocity of the filaments. At higher than about 99%, process problems develop which disrupt the continuity of operation; and, at lower than about 20%, the benefits of the invention are not realized over the processes of the prior art.

Operation of the invention must be controlled to avoid backsplash of the jetted sheets. When sheet velocity is too high, or the included angle between the sheets is too great, or the thickness of the jetted sheet is too large, the impingement of the sheets will cause the coagulating liquid to be splashed back on, as yet, uncoagulated filaments;—thus causing uneven fiber product qualities.

Backsplash may occur at sheet velocities of less that 99% of the velocity of the filaments if other conditions of the process are altered in such a way to generate such backsplash. Backsplash should be avoided in the practice of the present process.

The apparatus can include at least one guide for changing direction of the filaments below the location where the jetted sheets of liquid meet.

It has been recognized that increased spinning speeds cause a variation in fiber quality when radial spinnerets are used because the filaments, as they are drawn into the coagulating liquid, draw the coagulating liquid along and cause a depression in the surface of the coagulating liquid. That depression in the coagulating liquid creates a longer air gap for filaments near the center of the radial spinneret arrangement than the air gap for filaments at the edge of the arrangement. The variation in air gap yields a significant variation in fiber quality. U.S. Pat. No. 4,702,876 recognized the problem and attempted a solution by reducing the amount of coagulating liquid drawn away with the filaments.

It has, also, been recognized that high spinning speeds create a significant drag on the filaments due to the large difference in velocity between the filaments and the coagulating liquid and the resultant drag on the filaments.

The present invention provides fiber quality improvement and increased spinning speeds by mitigating both of the above-mentioned conditions. The use of a linear spinneret and a linear coagulating liquid delivery means eliminates the variation in path lengths through the air gap experienced with radial spinneret devices; and the use of high speed, laminar, jets of coagulating liquid—with no associated low speed or quiescent components—reduces the relative filament-to-coagulating liquid speeds and substantially eliminates coagulating liquid drag on the filaments. Filaments made by the present invention are not forced together and do not come into contact with any solid or mechanical surfaces until after being coagulated.

Spinning speeds for practice of this invention can range from less than 100 or 200 meters per minute to 1000 or 2000 meters per minute or, perhaps, higher.

BRIEF DESCRIPTION OF THE DRAWINGS

FIGS. 5 and 6 are simplified representations of acceptable patterns of apertures for use in the spinneret for practicing this invention.

DETAILED DESCRIPTION OF THE ILLUSTRATED EMBODIMENT

Figure 1:
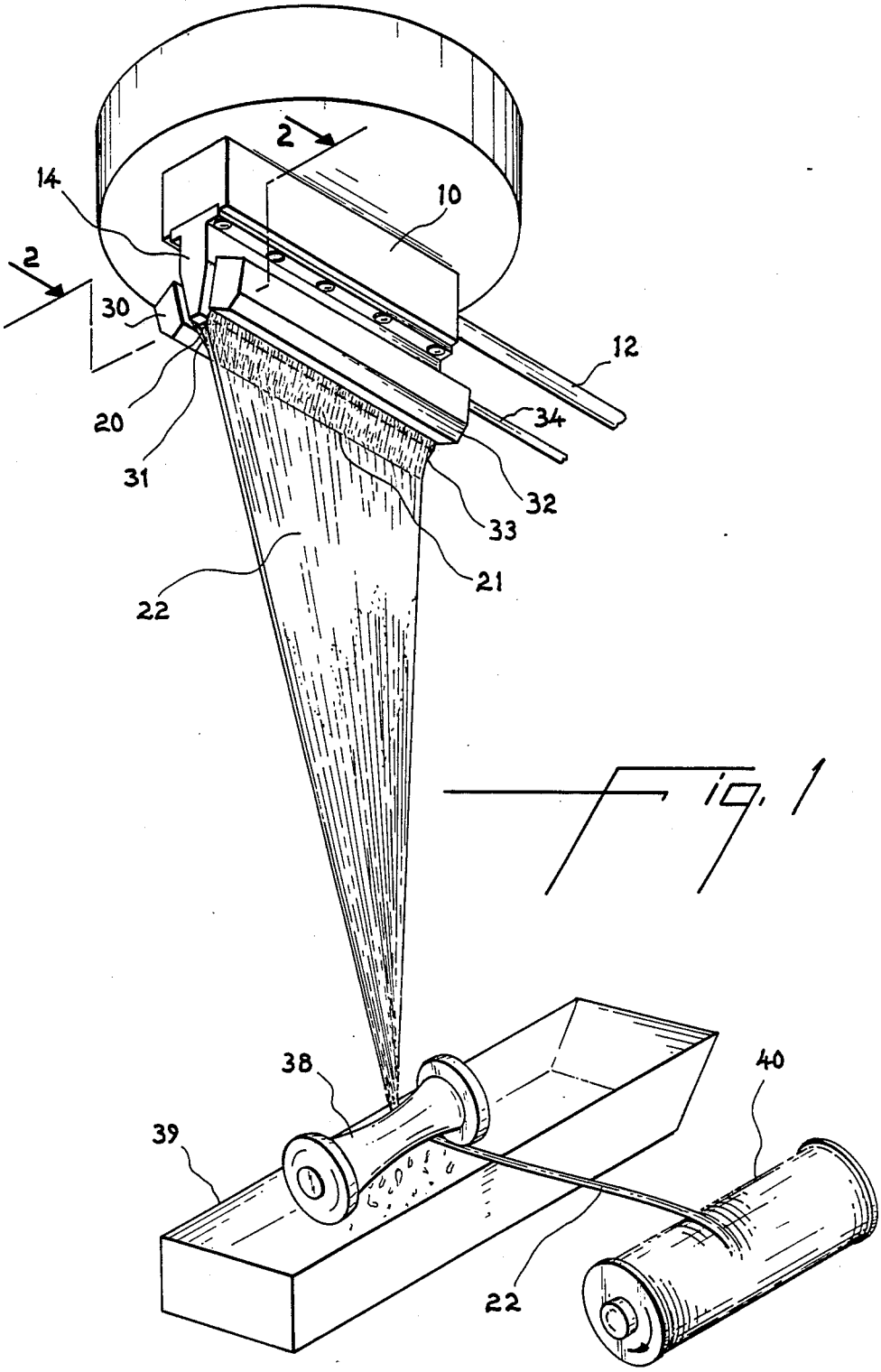
FIG. 1 is a perspective view of apparatus suitable to carry out the process of the invention.

Referring now to the drawings in which like or corresponding parts are designated by like reference characters throughout the several views, the apparatus chosen for purposes of illustration is shown in FIG. 1 and generally includes a spinning solution manifold 10 with its spinning solution supply pipe 12 connected thereto and a spinneret body 14 attached to the manifold. Spinneret apertures 16 are linearly arranged in accordance with FIGS. 5 and 6 wherein apertures 16 are arranged in rows across face 15 of spinneret body 14 and the positions of the apertures in each row are staggered so as to provide a warp 20 of uniformly spaced filaments 22 when coagulated and condensed below the spinneret.

Two linear jet bodies 30, 32 are located on opposite sides of the spinneret body and are supplied with coagulating liquid by means of supply pipe 34. A filament warp direction-changing guide 38 is located above liquid-collecting tank 39. A means for forwarding the warp of filaments, such as by a rotating spool, is designated by the element 40.

Figure 2:
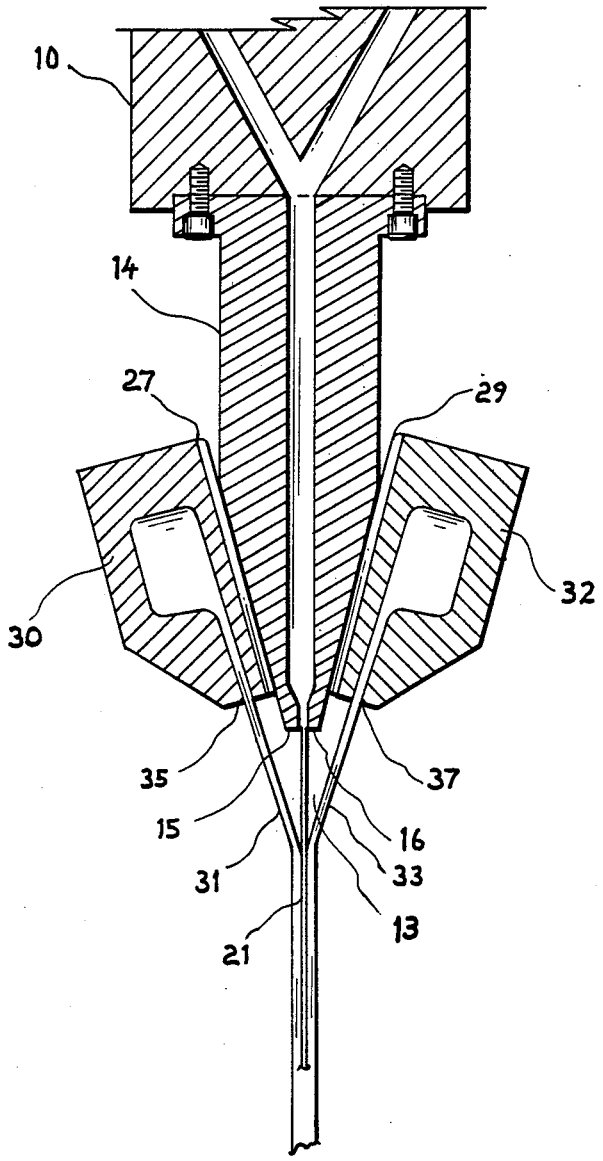
FIG. 2 is a cross-sectional elevation view of FIG. 1 taken on lines 2—2 of FIG. 1.

Referring to FIG. 2 it can be seen that jet bodies 30 and 32 are opposed to each other, are mounted at opposite sides of spinneret body 14 and parallel with the array of apertures 16, and can be insulated from the spinneret body by insulation panels 27 and 29. The jet bodies are capable of delivering sheets of coagulating liquid 31 and 33 from jet slots 35 and 37 to impinge at common line 21 across the warp 20 of filaments. The jet bodies 30 and 32 are directed such that extensions of the slots 35 and 37 meet at common line 21 vertically beneath the face 15 of the spinneret. The jet bodies 30 and 32 supply linear, substantially laminar flow, sheets of liquid 31 and 33. By "substantially laminar flow" is meant that the sheets of liquid are transparent to the eye. The sheets of coagulating liquid are wider than warp 20 at line 21.

Figure 3:
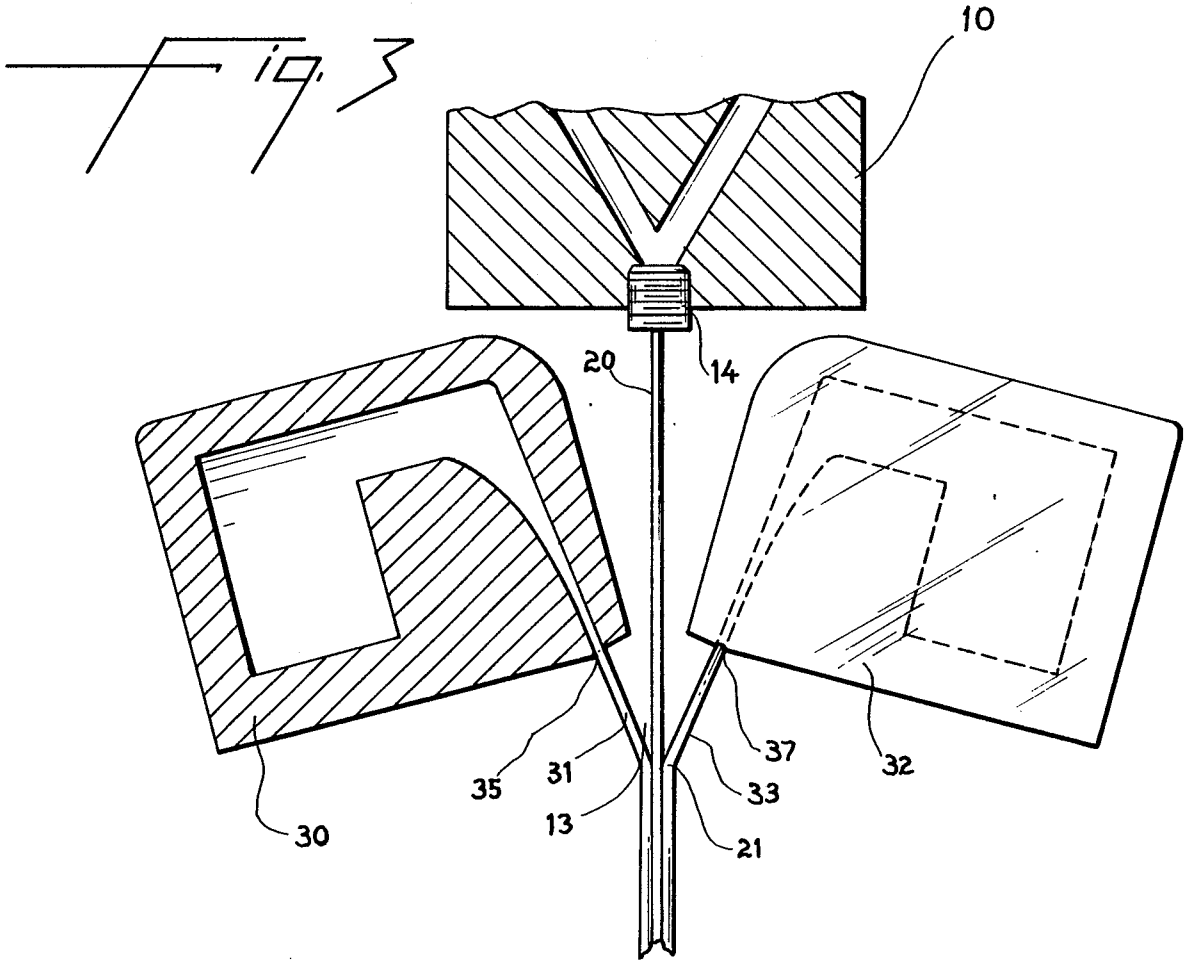
FIG. 3 is a partial cross-sectional elevation view of another apparatus suitable to carry out the process of the invention.

From FIG. 3, it can be seen that the jet bodies 30 and 32 need not be mounted in direct juxtaposition with the spinneret body 14; but can be affixed to the apparatus separate from the spinneret body. When such an arrangement as in this FIG. 3 is used, the angle formed between the jetted sheet of liquid 31 or 33 and the warp 20 is often larger than the angle formed in the arrangement of FIG. 2.

Figure 4:
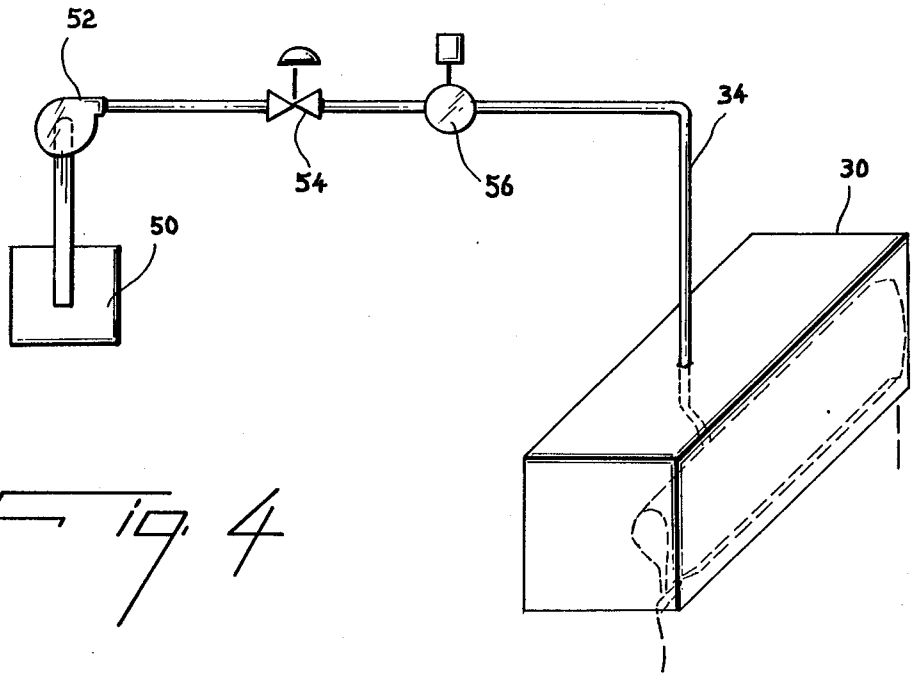
FIG. 4 is a simplified schematic diagram of the coagulating liquid flow control system.

Referring to FIG. 4, the coagulating liquid is supplied to a jet body 30 from a source 50 by means of pump 52 through control valve 54 and flow meter 56, all connected serially to pipe 34 supplying the jet body. The velocity of the jetted sheets can be varied by altering the operation of pump 52, by changing the setting of control valve 54, and by varying the thickness of jet slots 35 and 37.

In operation, an acid solution of para-aromatic polyamide is extruded through apertures 16 in spinneret 14 as filaments to form a vertical warp 20. The warp 20 is passed through an air gap 13 and is then coagulated by jetting two opposed transparent sheets of liquid 31, 33 toward the warp to meet at common line 21 across the warp. The liquid flows downwardly with the filaments and is separated from the filaments and caught in container 39 as the filaments change direction around guide 38. The filaments are then forwarded by means of element 40.

Although the length of the air gap is not necessarily critical to operation of this invention, the preferred air gap is 1 to 3 cm and can range from 0.5 to 7 or, perhaps, slightly more at the highest spinning speeds.

Although not critical or important to practice of this invention, the preferred coagulating liquids are aqueous, either water alone or water containing minor amounts of sulfuric acid. The coagulating liquid is usually at an initial temperature of less than 25° C., often less than 10° C., and preferably no higher than 5°.

The spinning solution is often at a temperature above 20° C. and usually is about 80° C. A preferred spinning solution is one that contains poly(p-phenylene terephthalamide). Other examples of appropriate aromatic polyamides or copolyamides are described in U.S. Pat. No. 3,767,756.

The array of apertures in the spinneret plate is preferably in a single row or a few rows, and are preferably less than six rows and not more than ten.

In spinneret plates with large numbers of apertures, the warp is usually divided into at least two sections with jetted sheets of coagulating liquid impinging each section. When very long linear spinnerets are used, there is a considerable distance required to gather the filaments of a wide warp down into a yarn. By dividing a wide warp into sections, the filaments can be more effectively gathered into yarn. Each section of a warp can be impinged by an individual pair of jetted sheets or all of the sections in a warp can be coagulated by a single pair of jetted sheets which sheets can, generally, be separated with a portion following each section.

DESCRIPTION OF THE PREFERRED EMBODIMENTS

In the conduct of the following examples, there were used different spinnerets and different coagulating jets. Those spinnerets and those coagulating jets will be described in some detail but it should be understood that a variety of spinnerets and coagulating jets can be used to practice this invention.

Figure 5:
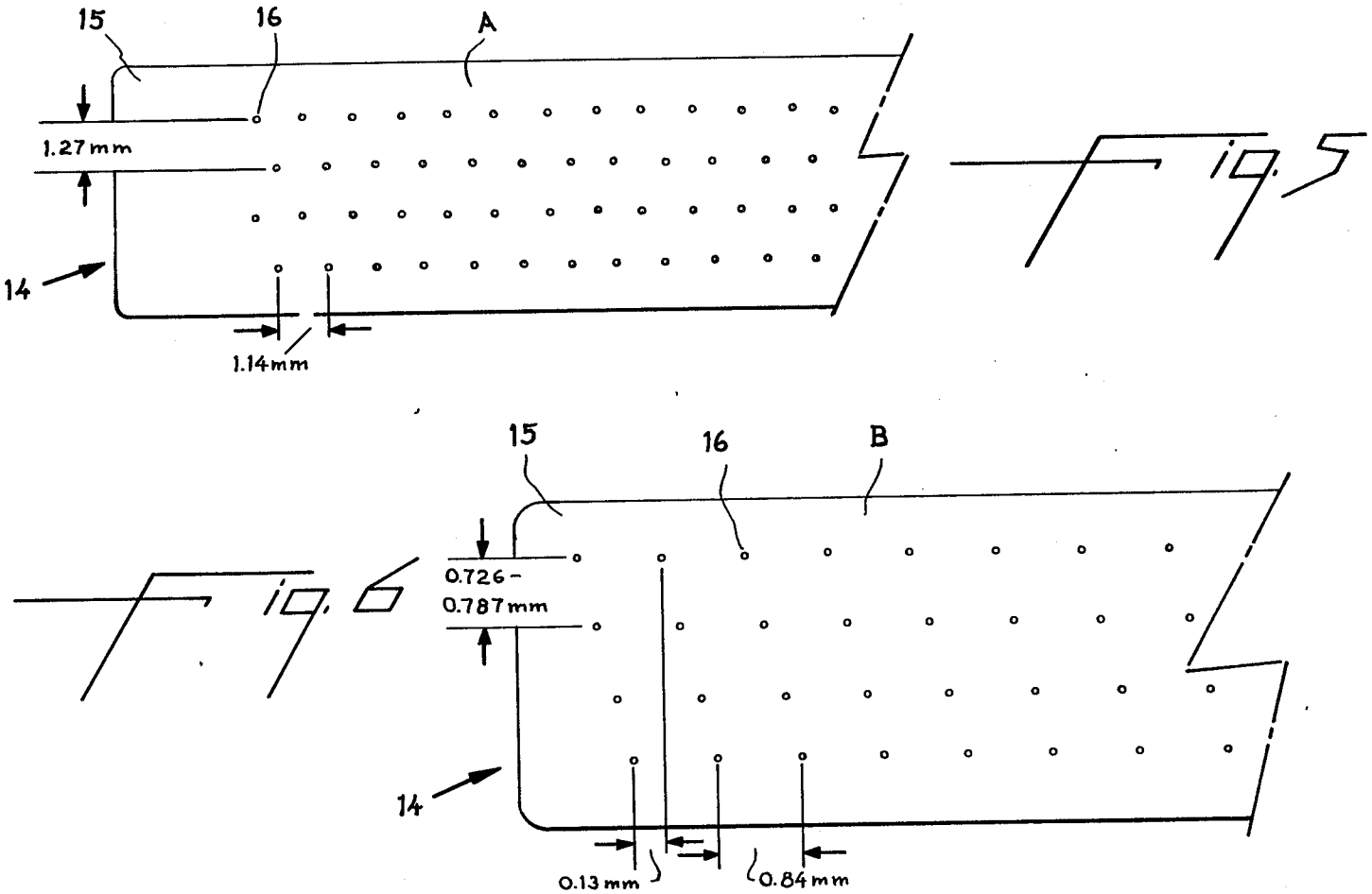

Spinneret "A", as shown in FIG. 5, had capillaries of 0.064 mm diameter and less than 0.2 mm length. There were 134 apertures in four rows and the apertures were in hexagonal closepacked arrangements. Yarn made using Spinneret A was 200 denier.

Spinneret "B", as shown in FIG. 6, had apertures similar to those in Spinneret A. There were 134 apertures in four offset rows. Yarn made using Spinneret B was 200 denier.

In practice of this invention, spinnerets, generally, have capillaries of 0.05 to 0.075 mm in diameter and the rows of capillaries are, generally, spaced apart 0.5 to 1.5 mm.

The different spinnerets were used with different coagulating jet configurations to demonstrate several embodiments of the invention. In one such configuration, designated to be Design 1 for purposes of this description, a pair of coagulating jet bodies were mounted adjacent to and somewhat beneath the face of the spinneret. That configuration is shown in Fig. 3. Due to the bulk of the coagulating jet bodies, the included angle for the line of impingement was 45° and the air gap was about 3.8 to 4.4 cm. The included angle is that angle made by the jetted sheets 31 and 33 (or the extension of slots 35 and 37) at common line 21 and the air gap is the distance from the face of spinneret 14 to the common line of impingement 21.

In another configuration, designated to be Design 2 for purposes of this description, a pair of coagulating jet bodies were mounted adjacent to and directly juxtaposed with the spinneret body somewhat above the spinneret face. That configuration is shown in FIG. 2. The included angle for the line of impingement was 30° and the air gap was about 1.3 cm.

It is believed that the magnitude of the included angle is important to practice of this invention only insofar as it is necessary to select an included angle which will not result in backsplash. Included angles of about 20 to 60 could be used.

Information relating to the manufacture of jet bodies which will yield substantially laminar flow (will yield jetted sheets which are transparent) can be found in *Rev. Sci. Instrum.*, Vol. 53, No. 12, pp. 1855–1858, 1982, Harri et al. and *Applied Physics*, Vol. 3, pp. 387–391, 1974, Wellegehausen et al.

Tenacity was the yarn property which was used as a measurement of fiber quality for demonstration of the present invention. It would be expected that fibers of high tenacity would exhibit correspondingly high qualities in other areas.

Tenacity was determined on yarn which had been washed, neutralized, dried, and wound up. Yarn to be tested was conditioned for at least 16 hours at 24° C. and 55% relative humidity. Yarn samples were given a twist sufficient to yield a twist multiplier of 1.1; and were broken with a gage length of 25.4 cm. Twist multiplier is defined as equal to the quantity [(twists/inch)(denier of yarn)$^{\frac{1}{2}}$/73].

The results of tests on five yarns were averaged. The rate of elongation was 10 percent per minute and load-elongation curves were plotted from a tensile testing machine. Denier of the yarn was determined by weighing a known length. Tenacity was obtained from the load-elongation curve and the calculated denier.

EXAMPLE 1

Poly(p-phenylene terephthalamide) was dissolved in 100.1% sulfuric acid to yield a 19.4%, by weight, spinning solution. The solution was spun at about 80° C. through Spinneret A with the coagulating jets of Design 1. After an air gap of about 3.8 cm, the spun filaments met with the opposed jets of coagulating liquid at the line of impingement and, immersed in the jetted coagulating liquid, were conducted past a change of direction pin and to a forwarding roll. The jetted coagulating liquid was, also, 3% sulfuric acid and was maintained at a temperature of about 3° C.

The width of the jets was about 7.6 cm and, for this example, the thickness of the jet slots was set at about 0.076 mm. Spinning was conducted at three speeds using three different speeds for the jetted sheets. Results are shown in Table I.

EXAMPLE 2

In this example, all parameters of the spinning and jet coagulating configuration were maintained the same as in Example 1 except that the thickness of the jet slots was increased to about 0.101 mm. Spinning was conducted at four speeds using four different speeds for the jetted sheets. Results are shown in Table I.

EXAMPLE 3

In this example, the spinning solution of Example 1 was spun at about 80° to 85° C. through Spinneret B with the coagulating jet bodies of Design 2. After an air gap of about 1.27 cm, the spun filaments met with the opposed jets of coagulating liquid at the line of impingement and, immersed in the jetted coagulating liquid, were conducted past a change of direction pin and to a take-up spool. The jetted coagulating liquid was 3% sulfuric acid and was maintained at a temperature of about 3° C.

The width of the jets was about 5.1 cm and, for this example, the thickness of the jet slots was set at about 0.127 mm. Spinning was conducted at two speeds using two different speeds for the jetted sheets. Results are shown in Table I.

TABLE I

| EXAMPLE | Spinning Speed (m/m) | Jet Speed (m/m) | Yarn Tenacity (gpd) |
|---|---|---|---|
| 1 | 594 | 548 | 26.2 |
| | 686 | 634 | 25.9 |
| | 777 | 676 | 25.7 |
| 2 | 503 | 460 | 25.4 |
| | 594 | 543 | 25.8 |
| | 686 | 627 | 26.1 |
| | 777 | 710 | 25.1* |
| 3 | 594 | 574 | 27.2 |
| | 686 | 663 | 27.2 |
| | 594 | 574 | 27.3** |

*Backsplash reduced quality of fibers.
**Run at 85° C. spinning solution temp. The others run at 80° C.

EXAMPLE 4

In this example, the spinning solution of Example 1 was spun at about 85° C. through Spinneret B with coagulating jet bodies of Design 2 as in Example 3.

The thickness of the jetted sheets was varied in three runs wherein the spinning speed was maintained constant at 594 meters per minute (m/m). The jet velocity was set at 578 m/m; but was reduced to 486 m/m for the thickest jet sheet to avoid backsplash. The results are shown in Table II. Note that the reduced jet speed resulted in slightly reduced tenacity.

TABLE II

| Jet Slot Thickness (mm) | Yarn Tenacity (gpd) |
|---|---|
| 5 | 27.2 |
| 6 | 27.7 |

TABLE II-continued

| Jet Slot Thickness (mm) | Yarn Tenacity (gpd) |
|---|---|
| 7.5 | 26.4 |

EXAMPLE 5

In this example, the spinning solution of Example 1 was spun at about 80° C. through Spinneret B with coagulating jet bodies of Design 1 and the length of the air gap was varied in three different runs. The spinning speed was set at 594 m/m, the jet velocity was set at 548 m/m, and the jet slot thickness was set at 0.076 mm. Results are shown in Table III.

TABLE III

| Air gap (cm) | Yarn Tenacity (gpd) |
|---|---|
| 1.9 | 27.0 |
| 3.2 | 26.3 |
| 4.4 | 25.6 |

EXAMPLE 6

In this example, the spinning solution of Example 1 was spun at about 85° C. through Spinneret B with coagulating jet bodies of Design 2 and the spinning speed, the jet velocity, and the jet slot thickness were varied in three runs. The air gap was maintained at about 1.3 cm. The results are shown in Table IV.

TABLE IV

| Spinning Speed (m/m) | Jet Speed (m/m) | Jet Slot Thickness (mm) | Yarn Tenacity (gpd) |
|---|---|---|---|
| 594 | 574 | 0.076 | 26.0 |
| 732 | 707 | 0.076 | 25.8 |
| 594 | 574 | 0.101 | 26.3 |

EXAMPLE 7

In this example, the spinning solution of Example 1 was spun at about 70° to 80° C. through a spinneret similar to Spinneret B and modified slightly such that there were a total of three separate segments of four rows of 63 apertures all in a linear configuration. There were a total of 252 apertures for each segment and the segments were separated by a distance of about 2.5 cm.

There were three pairs of coagulating jet bodies of Design 2 mounted such that each spinneret segment was centered between a pair of jet bodies. Fibers were spun, as in the previous examples, at several different spinning speeds utilizing the highest jet speed which could be used without causing backsplash or a problem with separation of the filaments from the coagulating liquid at the change of direction guides. The thickness of the jet slots was set at 0.101 mm and the air gap was about 1.9 cm. Filaments spun from all three of the spinneret segments were run to separate change of direction guides and were, then, consolidated into a single yarn of about 1134 denier. Results are shown in Table V and a graphic representation of the yarn tenacity as a function of the spinning speed is provided in FIG. 7.

As a comparative example, the same spinning solution, at the same spinning conditions, was spun through a radial spinneret having 767 apertures arranged in concentric circles within an outer circle of about 3.8 cm and of a diameter to yield a yarn of 1150 denier. The solution was spun from the circular array of apertures into a coagulating tray/jet apparatus corresponding to Tray G shown in FIG. 1 of U.S. Pat. No. 4,340,559. The spin tube had a diameter of about 7.6 mm. The solution was spun through an air gap of about 0.65 cm at four different spinning speeds with the jets of that apparatus increasing correspondingly. Results are shown in Table V and a graphic representation of the yarn tenacity as a function of the spinning speed is provided in FIG. 7.

Figure 7:
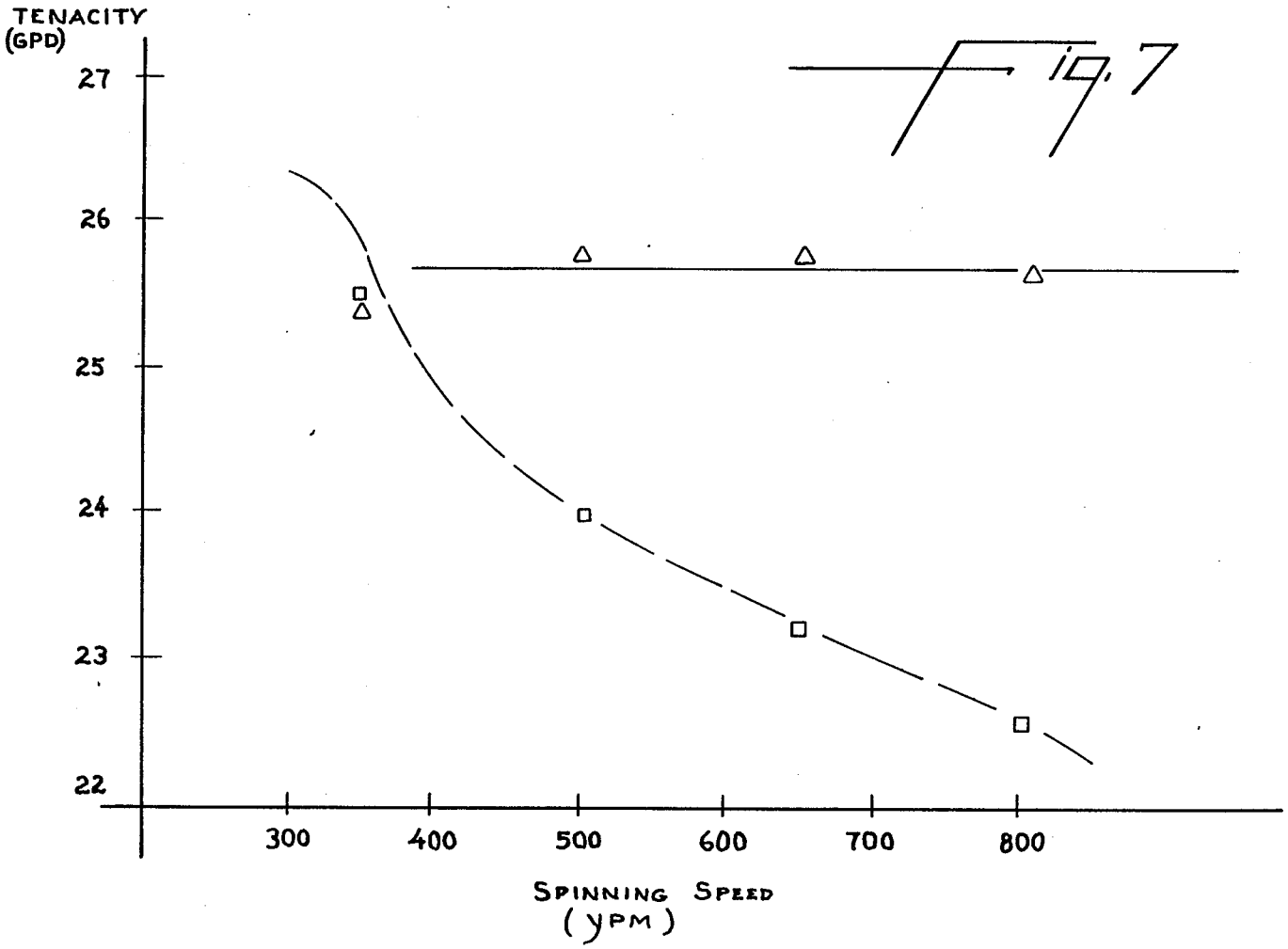
FIG. 7 is a graphical representation of the tenacity of fibers for different spinning speeds comparing fibers of the prior art with fibers made by the present invention.

FIG. 7 clearly shows that the tenacity of fibers made by the present invention is substantially unchanged by increase in the spinning speed while the tenacity of fibers made by the indicated prior art process and apparatus is markedly reduced with increase in spinning speed.

TABLE V

| Spinneret Type | Spinning Speed (m/m) | Jet Speed (m/m) | Yarn Tenacity (gpd) |
|---|---|---|---|
| Linear | 320 | 309 | 25.4 |
| Linear | 457 | 441 | 25.8 |
| Linear | 594 | 574 | 25.8 |
| Linear | 732 | 707 | 25.7 |
| Radial | 320 | 491 | 25.5 |
| Radial | 457 | 670 | 24.0 |
| Radial | 594 | 851 | 23.2 |
| Radial | 732 | 1026 | 22.6 |

I claim:

1. A process for preparing filaments from a solution of polymer by extruding the solution through linearly arranged apertures in a spinneret to form a vertical warp of filaments traveling at a first velocity downwardly through an gap, jetting opposed sheets of coagulating liquid at a second velocity from each side of said warp at an angle with said warp to meet at a common line across the width of the warp below the face of the spinneret, each of said sheets of liquid being wider than said warp at said common line, said second velocity having a vertically downward component that is from about 20% to about 99% of said first velocity.

2. The process of claim 1 wherein the polymer is a papa-aromatic polyamide and the solution is optically anisotropic.

3. The process of claim 2 wherein the para-aromatic polyamide is poly(p-phenylene terephthalamide).

4. The process of claim 1 including the step of changing the direction of said filaments below said common line.

5. The process of claim 1 wherein the first velocity is from 200 to 2000 meters/minute.

6. The process of claim 1 wherein the opposed sheets of liquid are transparent.

* * * * *